United States Patent [19]

Heinrich et al.

[11] Patent Number: 4,559,772

[45] Date of Patent: Dec. 24, 1985

[54] FALSE TWIST TEXTURIZED YARN, AND A PROCESS FOR ITS PREPARATION

[75] Inventors: Karl Heinrich, Grossaitingen; Norbert Heichlinger, Königsbrunn; Adolf Donig, Bobingen, all of Fed. Rep. of Germany

[73] Assignee: Hoechst Aktiengesellschaft, Fed. Rep. of Germany

[21] Appl. No.: 464,037

[22] Filed: Feb. 4, 1983

[30] Foreign Application Priority Data

Feb. 13, 1982 [DE] Fed. Rep. of Germany ..... 3205188

[51] Int. Cl.[4] ..... D02G 3/26; D02G 1/02

[52] U.S. Cl. ..... 57/247; 57/284

[58] Field of Search ..... 57/3, 6, 7, 12, 210, 57/211, 238, 239, 243–247, 284, 285, 289, 290, 337–339, 351, 908

[56] References Cited

U.S. PATENT DOCUMENTS

| | | | |
|---|---|---|---|
| 2,979,883 | 4/1961 | Waltz | 57/244 X |
| 3,388,547 | 6/1968 | Koga et al. | 57/246 X |
| 3,401,516 | 9/1968 | Chidgey et al. | 57/247 X |
| 3,420,049 | 1/1969 | Heberlein | 57/224 X |
| 3,438,193 | 4/1969 | Kosaka et al. | 57/228 |
| 3,472,017 | 10/1969 | Nakayama et al. | 57/245 |
| 3,553,953 | 1/1971 | Ponson | 57/246 |
| 3,651,633 | 3/1972 | Steinmiller | 57/247 |
| 3,691,750 | 9/1972 | Waters | 57/290 X |
| 3,921,382 | 11/1975 | Tsujita et al. | 57/283 X |
| 4,134,252 | 1/1979 | Otaki et al. | 57/339 X |
| 4,169,349 | 10/1979 | Talbot | 57/247 X |
| 4,218,869 | 8/1980 | Newton | 57/908 X |
| 4,246,747 | 1/1981 | Plunkett | 57/246 X |
| 4,262,481 | 4/1981 | Otaki et al. | 57/247 X |
| 4,341,063 | 7/1982 | Southerlin | 57/245 X |

*Primary Examiner*—Donald Watkins

*Attorney, Agent, or Firm*—Connolly and Hutz

[57] ABSTRACT

The invention relates to a yarn composed of false twist texturized synthetic yarn components where one of the components only has a crimp contraction of less than 10% and to a process for preparing the yarn, in which the yarn component with reduced crimp contraction is obtained by using a number of turns of false twist reduced to 35 to 65% of the Heberlein value and, if appropriate, texturizing temperatures of 120° to 180° C.

14 Claims, 7 Drawing Figures

FALSE TWIST TEXTURIZED YARN, AND A PROCESS FOR ITS PREPARATION

The invention relates to a false twist texturizing yarn and to its preparation by doubling and, if desired, air-blasting two yarn components false twist texturized in opposite directions.

The state of the art discloses a number of processes for preparing twist-neutral or non-twistlively yarns by doubling two yarns which have been false twist texturized in opposite directions. Yarns which have been false twist texturized in opposite directions are here understood as meaning those yarns which, in the customary false twist texturizing process, were in a state of opposite high twist, i.e. experienced a temporary twist either in the S or the Z direction. While false twist texturized yarns which only consist of filaments which have all been twisted up in the same direction have a twisting tendency or are twistlively even after back-twisting, this is no longer the case in the combination of two yarns which have been false twist texturized in opposite directions, because, in general, any torques remaining after the false twist texturizing cancel each other out. The doubling of ends which have been false twist texturized in opposite directions can be supported by intermingling with one another the monofilaments of the various components, as described, for example, in German Offenlegungsschrift No. 1,710,639, or even by imparting a slight twist to the doubled yarns, which is, however, usually associated with a reduction in the volume and the crimp elasticity.

Twist-neutral yarns have also already been prepared as mixed yarns composed of filaments of various raw materials. For example, German Offenlengungsschrift No. 2,248,556 proposes doubling false twist texturized cellulose acetate yarns together with corresponding yarns made of polyester, polyamide and the like, while East German Patent No. 141,933 describes a process in which polyamide and polyester yarns are doubled and air-blasted in order to obtain special dyeing effects. In the case of these twist-neutral yarns of the state of the art care is taken to texturize the two yarn components under optimal conditions. In the case of synthetic yarns the optimal number of turns of false twist, i.e. the number of turns per unit length temporarily applied during false twist texturizing, can be estimated by the so-called Heberlein formula (cf. British Patent No. 707,859):

$$\text{Optimal number of turns of false twist: } \frac{275{,}000}{\text{den} + 60} + 800 \text{ (turns/m)}$$

If a number of turns of false twist is used which is in the proximity of the Heberlein formula value, optimal bulk and particularly good crimp values of the filaments or yarns treated are generally observed.

In frictional texturizing, on the other hand, no precise statement is possible about the temporarily applied twist, as, for example, Arthur and Welle noted in J. Text. Inst., No. 2 (1960), T 66 et seq. Commercially the optimal texturizing data, in particular the D/Y value, are determined from the crimp values of texturized yarns; it can be demonstrated, by means of involved measuring methods, that the twist actually applied by frictional twisters then in turn corresponds to the known Heberlein value.

Such a texturizing process turns smooth filament yarns into crimped bulky yarns which can be processed into sheet structures which have an appearance and a volume which resembles that of sheet structures made from staple fibers. However, the "synthetic" appearance, the handle and the drape of such sheet structures made from false twist texturized synthetic yarns are still considered unsatisfactory.

In contrast, the state of, for example, goods knitted from texturized viscose filament yarns is called silky and flowing. Hitherto it was impossible to obtain a corresponding outcome in the case of textile sheet structures made from synthetic material.

It was therefore still the object to develop suitable texturized filament yarns which consist of synthetic filaments, which can be processed into textile sheet structures and which have the appearance, the handle and the drape of sheet structures made of texturized viscose filament yarns but which need not be prepared by a complicated wet-spinning technique and, furthermore, do not have low dimensional stability and continual shrinkage in every wash.

It has now been found, surprisingly, that false twist texturizing yarns which consist of two synthetic filament components which have different twisting tendencies can be processed into textile sheet structures, having hitherto unknown properties if the filaments of one component have a reduced crimp contraction which is less than 10%, usually less than 6%, and preferably less than 3% and the monofilaments of the other yarn component have a customary crimp contraction of greater than 30%, preferably greater than 50%. It is thus required that the crimp contraction values of the filaments of the two yarn components differ considerably from each other. If the crimp contraction value of the normal false twist texturized component is set equal to 100%, the filaments of the other component should only have crimp contraction values which are less than 35% relative to the normally texturized component, preferably 1 to 20%. Preferably the filaments of these two components consist of the same fiber-forming substance, in particular of fiber-forming polyesters.

Such false twist texturizing yarns can be obtained by doubling and, if desired, additional air-blasting two yarns which have been false twist texturized in opposite directions, if one yarn component is false twist texturized under optimal conditions in a customary manner, i.e. namely at an optimal temperature and with a false twist which is approximately given by the abovementioned Herbelein formula, while the other yarn component is subjected to a twist in opposite direction which only amounts to 35 to 65, preferably 40 to 55, % of the optimal false twist for this component.

Particularly attractive yarns are obtained when the yarn component which has a reduced number of turns of false twist is texturized at relatively low temperatures. Preferably the normally texturized component is texturized or draw texturized at customary temperatures, of about 200° C., while the yarn component which has a reduced number of turns of false twist is texturized or draw texturized at 120° to 180° C. It is particularly preferable to use identical yarn components as the starting material, but further effects can also be achieved by means of mixtures which differ in raw material, denier, profile and the like.

In the process according to the invention, the other texturizing parameters than the number of turns of false twist and, if desired, the texturizing temperature are selected from within the customary range, as shown, for example, in the survey by Scherzberg in "Melliand Textilberichte" (1966), Issue 2 to Issue 12.

The yarns can be doubled at any time after the false twist texturizing process, but they are preferably doubled immediately after the false twist texturizing before take-up onto a bobbin of the texturizing machine. The doubling can particularly preferably be further improved by an intermingling process. Such an intermingling is customarily effected by using air jets, care must be taken to maintain an adequate yarn tension in order to avoid the formation of loop yarns, which is possible under these conditions.

The process is particularly simple and gives homogeneous yarns in particular when the two yarn components have been prepared on immediately adjacent texturizing positions and are doubled after passing through the twisters and, if desired, air-blasted. In these circumstances it is admittedly usually impossible to operate with the texturizing heaters at different temperatures for the different yarn components. However, by using appropriate yarn guides it is possible, for example, to shorten the dwell time of a yarn on the texturizing heater compared to the dwell time of the normal component.

However, as has already been stated above, it is also possible to double and, if desired, air-blast the yarn components at a later time, if desired directly before entry into a knitting machine.

In this case one must be careful to feed the yarn components at a constant velocity for a given tension, unless differing feed velocities or feed tensions are intended to produce special yarn effects to which this application does not relate.

If the false twist texturizing machines used employ spindle twisters, the number of turns of false twist can be exactly adjusted through the rotational speed of the spindles. If frictional twisters having multiaxial disc assemblies are used, the number of turns of false twist can be preferably fixed through the spacing of the axes of the disc assemblies.

Identical yarns are preferably used as the starting material for the process according to the invention. Drawn yarns from cops can be false twist texturized, but so-called high speed filament yarns as described, for example, in German Offenlegungsschrift No. 2,211,843 are preferred. When such filament yarns are used, the yarn components must be simultaneously stretched during the false twist texturizing process.

It is an essential feature of the invention that the two yarn components which have been false twist texturized in opposite directions differ markedly in the number of turns of false twist inserted. The markedly lower number of turns in the second component leads to crimp contraction values of less than 10%, usually even less than 6%, compared to crimp contraction values of about 50% and more in the case of the component with a normal number of turns of false twist.

By using yarns according to the invention it is possible to produce textile sheet structures which, in their surface texture, their handle and their drape, differ markedly to those made of known false twist texturized yarns and from sheet structures made of twist-neutral synthetic texturized yarns. For example, the outcome of a fabric circular-knitted from a 2-ply 24-filament 76-dtex yarn prepared according to the invention is called silky, flowing and refined by those skilled in knitting. This effect can be reinforced by suitable profiling, such as, for example, a triangular profile. The outcome of the finished goods can be most suitably compared with that of goods knitted from false twist texturized viscose filament yarns.

If yarns according to the invention are used to produce knitted goods in double relief, texture or modified uni designs, the goods appear three-dimensional, an effect which could hitherto only be obtained from high-twist viscose yarns.

The causes for these surface effects on knitted goods could reside in a very fine loop structure of the yarns according to the invention. Such a loop structure can be made evident on extremely loose knitting up. If, for example, a yarn according to the invention is knitted on a single-lock knitting machine using a feed tension of only 4 cN, a sheet structure is obtained after the heat treatment of a washing or dyeing process which has a pronounced terry structure which is explained in more detail in Example 1. This "terry structure" can be optimized through a suitable choice of the number of turns of false twist inserted and of the texturizing temperature. In the case of correspondingly more tightly meshed knitted goods, this optimum also produces, approximately, the optimum in the abovementioned change in the surface texture in the viscose texturizing yarn direction. Yet the resulting improvements in the surface texture, handle and drape can be measured, if at all, only qualitatively, in some cases only subjectively. However, the formation of the terry structure which the knitted goods investigated have permits objective optimization.

Figure 1:
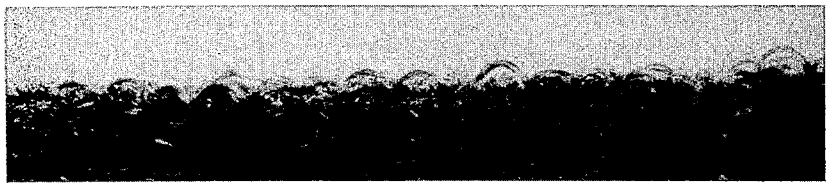
FIGS. 1–3 illustrate samples of knitted tubes, according to the present invention.

In the examples which follow the invention will be illustrated in more detail. One effect demonstrated is that of the reduced number of turns of false twist in one component. A further example shows how a yarn according to the invention can be manufactured in bulk, and a further example shows the effect of the texturizing temperature on the structure of the texturizing yarn according to the invention.

In the examples the values given for tensile strength and elongation at break respectively are understood as meaning the count-related maximum tensile strength and maximum tensile elongation according to DIN No. 53,815, and the boil shrinkage or thermal shrinkage values were determined in accordance with DIN No. 53,866 and those for crimp contraction and crimp stability according to DIN No. 53,840.

EXAMPLE 1

The following example demonstrates the preparation of the texturizing yarn according to the invention by doubling of two false twist texturized yarn components. The starting yarn spun for the two components was a round bright 24-filament 86-dtex polyethylene terephthalate high speed yarn which had been wound up with a take-up speed of 3,000 m/min. The texturizing draw ratio of these yarns was 1:1.5.

The normally texturized component, which was draw texturized in a customary manner, was prepared while maintaining the following parameters:

| | |
|---|---|
| Texturizing draw ratio | 1:1.5 |
| Surface temperature of the heater (125 cm long) | 200° C. |
| D/Y value | 1.64 |
| Yarn tension before/after the twister | 15/22 cN |
| Take-off speed | 310 m/min |

The D/Y value is the ratio of the peripheral speed, of the twister discs (D) to the yarn speed (Y). The twister used were 3-axial frictional twisters from Messrs. Barmag, Barmer Maschinenfabrik AG, each of which had three (R)KYOCERA ceramic discs.

This normally texturized yarn component had the following textile data:

| | |
|---|---|
| Count | 57.2 dtex |
| Tensile strength | 30.4 cN/tex |
| Elongation at break | 25.7% |
| Boil shrinkage | 5.8% |
| 200° C. thermal shrinkage | 6.1% |
| Crimp contraction | 54.1% |
| Crimp stability | 85.8% |

This example shows a series in which the second component, texturized with a small amount of false twist, was given different numbers of turns of false twist, which were set exactly with the aid of a spindle. The two components were then doubled at the knitting machine and knitted up with a loose setting. A type SBV-A 2 tubular knitting machine from Messrs. Santoni, which had a gage of 8, a diameter of 3.5" and 88 needles, was used for this purpose. The feed tension was about 4 cN.

The draw ratio in the texturizing was 1:1.5, as in the case of the normal component; the heater temperature was 200° C.; the number of turns of false twist inserted was varied; and the false twist imparted had Z direction, while the normal component was false twist texturized in S direction. The Heberlein number of turns of false twist is calculated as 3,270 turns/m.

| | Sample No. | | | |
|---|---|---|---|---|
| | 1a | 1b | 1c | 1d |
| Number of turns/m | 750 | 1,090 | 1,360 | 1,720 |
| Yarn tension cN before/after twister | 30/72 | 30/62 | 27/56 | 22/48 |
| Count dtex | 57.8 | 58.7 | 58.8 | 59.1 |
| Tensile strength cN/tex | 43.3 | 32.6 | 17.5 | 23.4 |
| Elongation at break % | 32.9 | 32.5 | 11.8 | 21.3 |
| Boil shrinkage % | 4.5 | 4.2 | 4.4 | 4.9 |
| Thermal shrinkage % at 200° C. | 7.7 | 7.1 | 6.4 | 6.6 |
| Thermal shrinkage % at 120° C. | 5.7 | 4.4 | 3.3 | 3.7 |
| Crimp contraction % | 0.7 | 0.5 | 0.7 | 1.9 |
| Crimp stability % | −45.2 | −46.7 | +15.1 | +24.9 |

In the subsequent knitting, in each case a normally texturized yarn and a component of samples 1a to 1d were doubled before the knitting machine, care being taken to have identical feed-in speed and yarn tension.

The knitted tubes obtained were then dyed under the following conditions:

Sample weight: 50 g

Dyeing liquor: 2.5 liters of water containing 0.75 g of Disperse Blue 139 and 7.5 ml of o-phenylphenol-based carrier Dyeing conditions: 30 minutes at 95° C. in a Mini-Jet dyeing apparatus from Messrs. Mathis AG, Niederhasli (Switzerland)

The samples were then rinsed with water, centrifuged and dried.

The knitted tubes thus obtained from the doubled yarns had a terry-like loop structure which at the lower end became more pronounced with an increasing number of turns of false twist inserted into the second component. A loop structure optimum was obtained for the doubled yarn when using yarn component 1*c*, whose number of turns of false twist was about 40% of the Heberlein formula value. A further increase in the number of turns of false twist inserted into the second component, which forms the loops, led to crinkling in the projecting loops and to an increase in the finer curliness of the filaments of this component.

Figure 2:
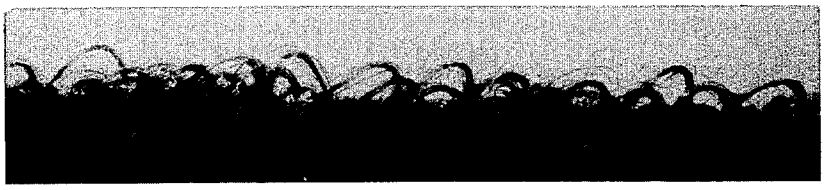
Figure 3:
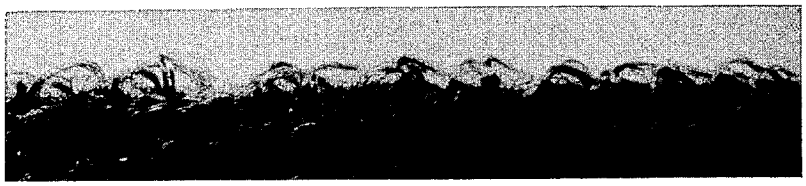

Samples of the knitted tubes obtained with samples 1*a*, 1*c* and 1*d* are shown enlarged in FIGS. 1 to 3. The formation of a loop structure can be seen at the outer edges of the knitted tubes. FIG. 1 shows the knitted tube obtained when using yarn component 1*a*. In this yarn component a number of turns of false twist of only 750 turns/m was inserted, which corresponds to 22.9% of the theoretical value according to Heberlein. Relatively few pronounced loops can be seen at the edge of the tube.

FIG. 2 shows the outcome when using component 1*c*, which had a number of turns of false twist of 1,360 turns/m, which corresponds to 41.5% of the Heberlein value. The loops are highly developed and project like arcs above the bulk of the knitted fabric. In FIG. 3, sample 1*d* was processed together with the normal component. Component 1*d* has a number of turns of false twist of 1,720 turns/m, which corresponds to a value of 52.5% of the value in accordance with the Heberlein method.

In this sample, the loops of the component with the smaller number of turns of false twist no longer project far above the bulk of the material and show crinkles and a finer degree of curliness.

If the yarns made of mixtures of the yarn component with normal false twist texturizing and yarn components with a reduced number of turns of false twist are knitted up under customary conditions, it is found that the desirable features of these textile sheet structures change roughly in parallel with the terry structure observed in the sample pieces.

EXAMPLE 2

This example shows the preparation of a yarn according to the invention through the sole use of frictional twisters. A draw texturizing machine was used which had been equipped with tri-axial frictional twisters from Messrs. Barmag AG, each of which had been fitted with three KYOCERA ® friction discs. The yarn was inserted into these twisters in a customary manner, namely by folding out one of the three axes. To insert the lower amount of false twist into the second component, this yarn was texturized with a half-open twister, i.e. with increased spacing between the axes, while the first component was texturized as customary with a closed twister. In the closed state the three axes are 38 mm apart, which was increased to 49 mm to insert the lower amount of twist. One specimen each of a yarn with normal false twist (completely closed twister) and of a yarn with reduced false twist (partially closed twister) were doubled after leaving the twisters, and intermingled with the aid of an air jet. The starting yarns and all the parameters not mentioned in the table which follows correspond to the data of Example 1.

| Texturizing parameters | Normally texturized yarn component (A) | Yarn component with reduced number of turns of false twist (B) | Yarn according to the invention by doubling + air-blasting 1 × A and 1 × B |
|---|---|---|---|
| Axis spacing (mm) | 38 | 49 | |
| D/Y value | S 1.64 | Z 1.64 | |
| Yarn tension before/after twister (cN) | 15/22 | 30/37 | |
| Textile test values | | | |
| Count dtex | 57.2 | 58.6 | 118.1 |
| Tensile strength cN/tex | 30.4 | 28.0 | 27.2 |
| Elongation at break % | 25.7 | 25.4 | 26.2 |
| Boil shrinkage % | 6.6 | 6.9 | 3.9 |
| Thermal shrinkage at 200° C. % | 8.0 | 8.2 | 6.0 |
| Crimp contraction % | 54.1 | 5.9 | 24.3 |
| Crimp stability % | 85.8 | 36.6 | 89.3 |

The knitted tube samples made from the doubled and intermingled yarn obtained corresponded in their loop structure to those which had been obtained from normally texturized material and sample 1*c* of Example 1, and the tightly knit fabrics had the desired viscose-like handle and drape.

EXAMPLE 3

The texturizing machine was again fed with bright round 24-filament 86-dtex polyethylene terephthalate material spun at high speed. The normally texturized material was again produced with the aid of a frictional twister from Messrs. Barmag, Barmer Maschinenfabrik, which had been equipped with three sets of three KYOCERA ® discs. In draw texturizing the material was given a Z twist, the heater being 125 cm long. The following values were also obtained:

| | |
|---|---|
| D/Y value | 1.86 |
| Draw ratio | 1:1.5 |
| Heater temperature | 200° C. |
| Take-up speed | 270 m/min |

The yarn, or rather the yarn component, obtained had the following test results

| | |
|---|---|
| Crimp contraction | 50.5% |
| Thermal shrinkage at 200° C. | 5.8% |
| Boil shrinkage | 3.5% |

The 2nd yarn component, with a reduced amount of false twist, was false twist texturized in S direction with the aid of a spindle. The heater was again 125 cm long. Further settings:

| | |
|---|---|
| Number of turns of false twist | 1,710 turns/m |
| Draw ratio | 1:1.5 |
| Heater temperature | 145° C. |

-continued

| | |
|---|---|
| Take-up speed | 270 m/min |

This yarn component had the following test results

| | |
|---|---|
| Crimp contraction | 1% |
| Thermal shrinkage at 200° C. | 7.9% |
| Boil shrinkage | 5.1% |

The two yarn components were doubled on a 10 gage knitting machine and knitted up jointly using a very low tension. After the knitted patterns have been washed, the end texturized with a small amount of false twist projects as a small loop in most of the stitches, and leads to the terry characteristics described. If the sample pieces obtained are washed and dyed, the textile sheet structure develops terry-like characteristics, of the type shown in FIG. 2. When such combined false twist texturized yarns are knitted up under customary yarn tensions, sheet structures are obtained which again have the desired viscose-like handle and drape.

An interesting point concerning the settings of Example 3 is that here, in contrast to the results of Example 1, a number of turns of false twist of 1,710 turns/m, which corresponds to 52.5% of the theoretical value according to Heberlein, still led to a utilizable yarn component. The reason for this is that in this example the temperature of the heater was lowered from a customary 200° to 145° C. Under these conditions the reduced crimp contraction desired is still obtained at somewhat higher numbers of turns of false twist than at higher temperatures.

Figure 4:
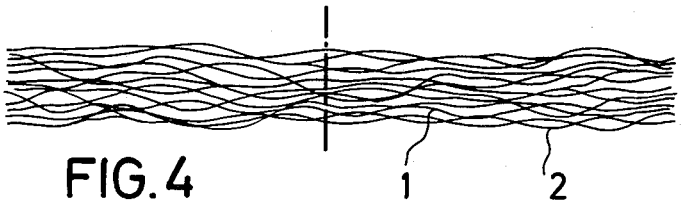
FIG. 4 illustrates a yarn, according to the present invention.
Figure 5:
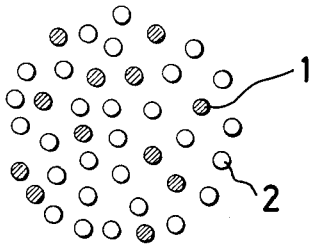
FIG. 5 is an enlarged sectional view of the yarn of FIG. 4.
Figure 6:
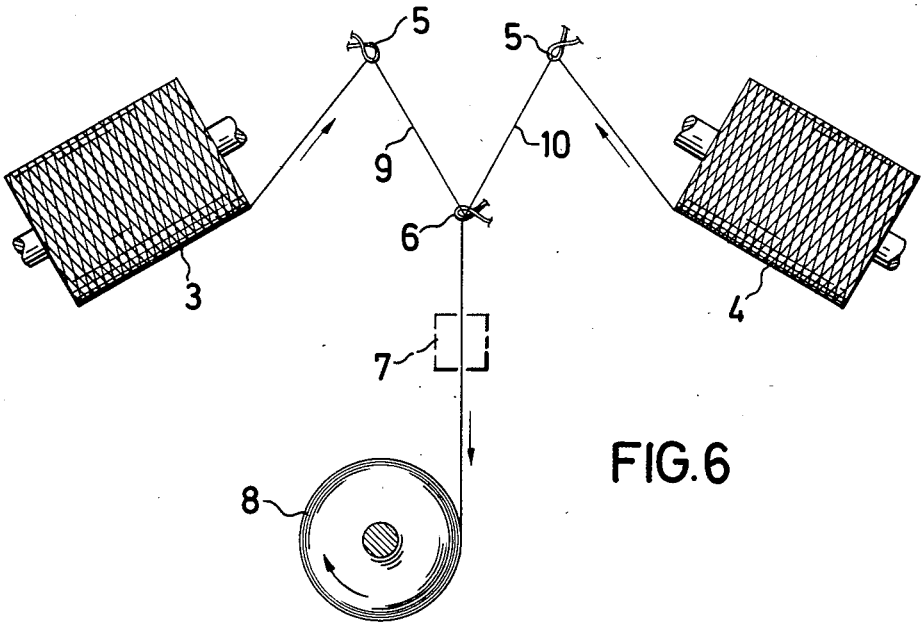
FIG. 6 is a diagrammatic representation of the process of the present invention.

Referring again to the drawing, FIG. 4 illustrates filaments 1 and 2 with the filaments 1 having somewhat less crimp than filaments 2. While there are differences in the crimp when comparing filaments 1 and 2, these differences are difficult to visually discern.

The running false twisted yarn component 9 consisting of filaments 1 is delivered from a spool or yarn supply 3. Similarly, textured filaments 2 of a second yarn component 10 are delivered from bobbin 4. The two yarn components 9 and 10 are guided by guide structure 5 and these yarns are doubled with the aid of collecting guide 6 which may be in the form of a pigtail guide. The doubled yarn passes an air-blasting device 7 prior to entering take-up structure 8.

Figure 7:
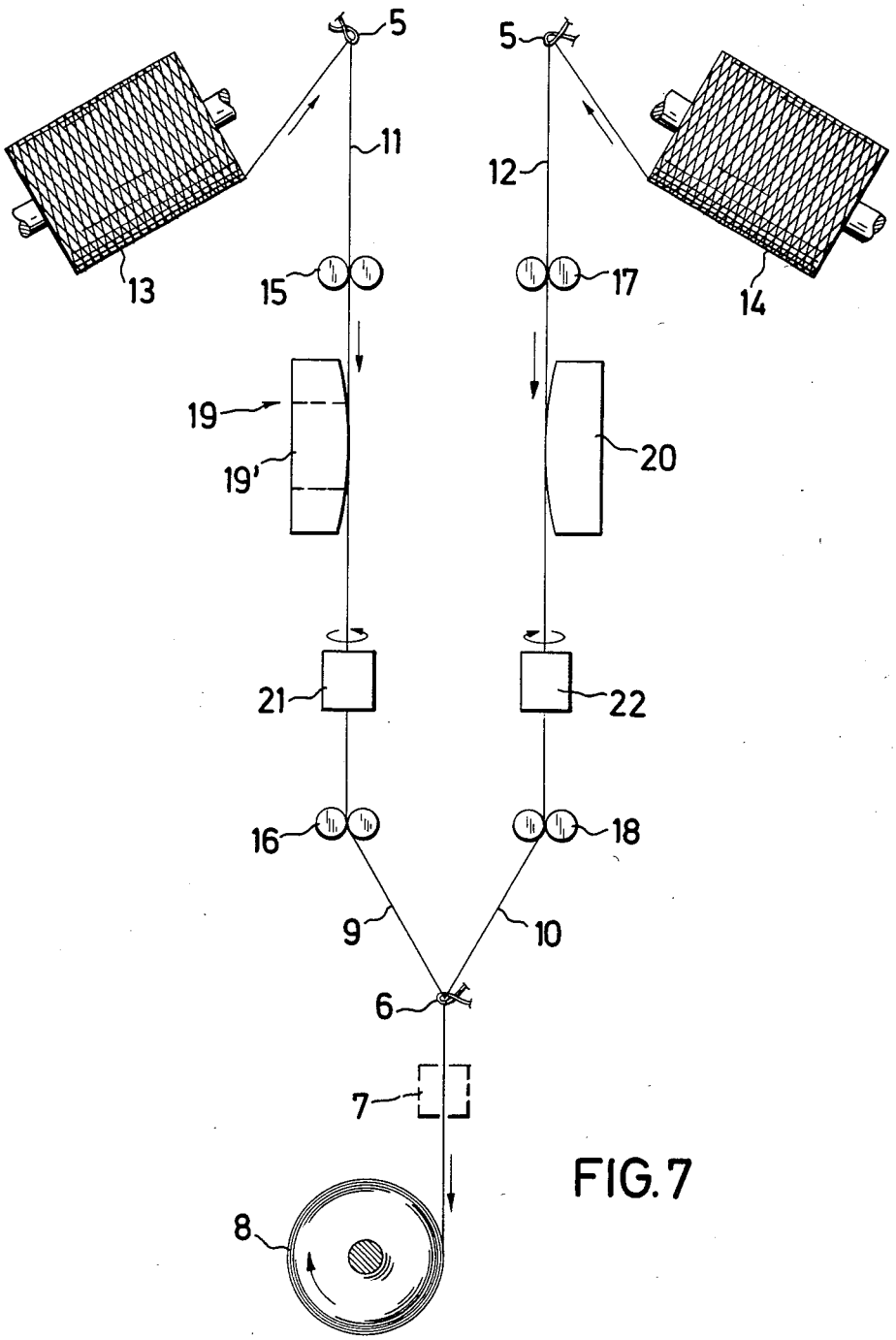
FIG. 7 is a further diagrammatic representation of the process invention described herein.

False twist texturizing optionally combined with drawing of the feed yarn components and downstream doubling is diagrammatically shown in FIG. 7. The feed yarn components 11 and 12 which may be drawn or be in a drawable state and which may be different or the same are withdrawn from package supplies 13 and 14 by the action of driving structure 15 and 17. The yarn components then pass heaters 19 and 20 and the false twist is induced by structures 21 and 22, each of which runs in a different direction. A smaller heater 19' may be used to apply less heat to the yarn components, when desired. The yarn components are now in a false-twisted state and then run through a second set of driving devices 16, 18 after which the texturized components 9 and 10 are plied together with the assistance of pigtail guide 6.

The manufacture of false twisted and drawn false twisted yarns is well documented in the prior art. Equally well documented is the doubling of two yarn components.

We claim:

1. A false twist texturized yarn from two yarn components of synthetic filaments which differ in their twist tendency, comprising that the filaments of one component have a reduced crimp contraction which is less than 10% and the filaments of the other yarn component have a crimp contraction greater than 30%.

2. The texturizing yarn as claimed in claim 1, wherein the yarn component with reduced crimp contraction has a crimp contraction of the filaments of less than 6%.

3. The texturizing yarn as claimed in claim 1, wherein the filaments of the two components are made of the same fiber-forming substance.

4. The texturizing yarn as claimed in claim 3, wherein a polyester is used as the fiber-forming substance.

5. A process for preparing a false twist texturized yarn by doubling of two yarns which have been false twist texturized in opposite directions, which comprises applying the full number, according to the Heberlein formula wherein the optimal number of turns of false twists =

$$\frac{275{,}000}{\text{den} + 60} + 800 \text{ (turns/m)},$$

of turns of false twist to one yarn component and a number of turns of false twist of 35 to 65 % of the theoretical number of turns of false twist according to the Heberlein formula to the other yarn component.

6. The process as claimed in claim 5, wherein the yarn component with the reduced number of turns of false twist is texturized at a temperature of 120° to 180° C.

7. The process as claimed in claim 5, wherein identical yarns are used as the starting material for the two components.

8. The process as claimed in claim 5, wherein unstretched but with high-speed spun and wound yarns are used as the starting material for the two yarn components which are simultaneously draw texturized.

9. The process as claimed in claim 5, wherein at least one of the yarn components is texturized by means of false twist spindles.

10. The process as claimed in claim 5, wherein the yarn components are false twist texturized by multiaxial disc assemblies which differ in the spacing of the axes of the discs.

11. The process as claimed in claim 5, wherein the two components are prepared on adjacent texturizing positions of a texturizing machine, doubled, after passing through the twisters and wherein, if desired, the yarn component with the reduced number of turns of false twist passes through a shorter path on the texturizing heater than the false twist component with a normal number of turns of false twist.

12. A false twist texturized yarn as in claim 1 wherein the filaments of the other yarn component have a crimp contraction greater than 50%.

13. A false twist texturized yarn as in claim 2 wherein the yarn component with reduced crimp contraction has a crimp contraction of the filaments of less than 3%.

14. A process as in claim 5 wherein the number of turns of false twist is 40 to 55% of the theoretical number of turns of false twist according to the Heberlein formula to the other yarn component.

* * * * *